US005218276A

United States Patent [19]

Yeom et al.

[11] Patent Number: 5,218,276

[45] Date of Patent: Jun. 8, 1993

[54] INTEGRATED CIRCUIT DEVICE OF REMOTE CONTROL TYPE FOR DRIVING A D.C. MOTOR

[75] Inventors: Hee-Chol Yeom; Tae-Seop Shim, both of Buchon, Rep. of Korea

[73] Assignee: Samsung Electronics Co., Ltd., Suweon, Rep. of Korea

[21] Appl. No.: 800,511

[22] Filed: Dec. 3, 1991

[30] Foreign Application Priority Data

Jun. 25, 1991 [KR] Rep. of Korea ..... 91-10602

[51] Int. Cl.[5] ..... H04Q 9/16

[52] U.S. Cl. ..... 318/16; 340/825.69; 340/825.72; 340/825.65

[58] Field of Search ..... 318/16, 293; 340/825.57, 825.6, 825.62, 825.63, 825.64, 825.65, 825.69, 825.72

[56] References Cited

U.S. PATENT DOCUMENTS 4,208,654 6/1980 Vogt et al. ..... 340/351

4,360,808 11/1982 Smith, III et al. ..... 340/825.69

4,390,877 6/1983 Curran ..... 340/825.72

*Primary Examiner*—Bentsu Ro

*Attorney, Agent, or Firm*—Cushman, Darby & Cushman

[57] ABSTRACT

An integrated circuit for driving a d.c. motor for use in a device, such as a toy car. The device include a noise filtering circuit, a pulse expansion circuit, a first oscillator, a second oscillator power voltage reset circuit, a constant voltage supplying circuit, a voltage detector, an inherent code input circuit, a right and left lamp driving circuit, a frequency dividing circuit, an inherent code detecting circuit, a received signal detecting circuit, an error signal detecting circuit, a comparator, a demodulator, a one-shot circuit, a servo-motor driving circuit, a speed variable driving circuit and an additional function driving circuit. Accordingly, a shared frequency can be utilized by a large number of people having an inherent code operably integrated. In addition, the variation of speed and position of the motor can be controlled in multi-steps, and the respective external elements can be minimized in size and erroneous device operation significantly reduced.

5 Claims, 5 Drawing Sheets

INTEGRATED CIRCUIT DEVICE OF REMOTE CONTROL TYPE FOR DRIVING A D.C. MOTOR

BACKGROUND OF THE INVENTION

1. Field of the Invention

The present invention relates to an integrated circuit device of a remote control type for driving a d.c motor, more particularly, to an integrated circuit device for driving a d.c motor, which can receive only a signal coinciding with a specific code previously stored in a receiver to control the motor linearly and execute additional functions thereof.

2. Description of the Prior Art

A conventional integrated circuit device of remote control type for driving a d.c motor used in a toy car is disclosed in Korean Patent publication No. 90-3992, which generally utilizes a d.c motor driving integrated circuit performing several functions including a turbo function. In such a device, there is provided a structure comprising a super regenerative receiver 1, amplifier 2, detector 3, comparator 4, motor driving circuit 5, constant voltage circuit 6, frequency detector 7, and antenna 8, wherein the device performs seven functions, such as, forward motion, backward motion, forward and right turning, forward and left turning, backward and right turning, backward and left turning and stop and an eighth turbo function.

In the d.c motor driving integrated circuit device constructed as mentioned above, the motor is rotated forward or reverse in accordance with a frequency transmitted from a transmitter. Also, the turbo function is carried out to change a rotational speed of the motor by varying d.c voltage applied to the motor when it is rotating forward. In addition, right or left turning is determined by a pulse width regardless of a rotational direction of the motor. If no signal is received from the transmitter, the device controls to stop an object, for example the motor.

In a conventional motor driving integrated circuit device, however, a specific code input circuit and a specific code detecting circuit are not provided therein, hence, a specific code cannot be used therewith. Accordingly, a number of people cannot use the same frequency, simultaneously. Further, since a received signal detecting circuit and an error signal detecting circuit are not used, an error in the received signal cannot be detected. An operation condition of the motor is determined in accordance with the d.c voltage produced by a frequency integration, so that it is very difficult to vary speed in the multi-stage and the position of the object to be controlled. Also, because input signals are not induced serially, there is provided an individual external element which is capable of receiving additional functions in the case when additional functions are further added to the device.

The conventional constitution is disadvantageous in that the manufacturing process is considerably complex, the manufacturing cost is high, and the substrate of the device is great in size.

SUMMARY OF THE INVENTION

Accordingly, the present invention has been made to remove the above-mentioned disadvantages of conventional motor driving integrated circuits. It is an object of the present invention to provide an integrated circuit device having multi-function capability for driving a d.c motor, and which can receive only that signal corresponding to a specific code stored in a toy car which is to be remoted-controlled so as to allow a same frequency to be used simultaneously by many people. A d.c motor mounted in the toy car can be controlled in multi-stage and operated linearly, and can easily carry out a plurality of additional funtions without use of external elements.

Another object of the present invention is to provide an integrated circuit for driving a d.c motor which can be reduced in size by minimizing external elements for performing given functions.

In order to achieve the aforementioned objects, the present invention provides an integrated circuit device of multi-function for driving a d.c motor, comprising; a noise filtering circuit for converting an input signal having a specific code received and amplified from a super-regenerative receiver into a desired magnitude of the input signal, and removing noise by using a hysteresis and delay circuit therein; a pulse expansion circuit for expanding the difference in pulse width of the demodulated output signal and a one-shot pulse into a time-width wide enough to drive a motor; a first oscillator for exchanging frequency automatically to produce a reference frequency while the specific code of receiver is modified; a second oscillator for producing a frequency determining ON/OFF time of right and left flickering lamps; a power voltage reset circuit for preventing an erroneous operation generated in a moment at the time of turning ON/OFF of the power supply; a constant voltage supplying circuit for stabilizing operation of the respective circuit from ripple or noise generated at the start of motors; a voltage detector for stopping operation of the output stage of the device, keeping operation of the integrated circuit device and maintaining the reference voltage stably when the power voltage is dropped below a predetermined level due to the start of the motor; a specific code inputting circuit for inputting the specific code selectively by external switches; right and left flickering lamp driving circuit turned ON/OFF at the turn of the right or left direction, the period of the turn ON/OFF being determined by a periodic time of the second oscillator; a frequency dividing circuit for dividing the frequency of the first oscillator; a specific code checking circuit for checking and comparing the specific code set in the receiver with the specific code of the received input signal; a received signal detecting circuit for converting serial input data into parallel data in case when the ready signal and specific code of an input signal coincide with the ready signal and specific code of a received signal detecting circuit; an error signal checking circuit for not-outputting any signal when from the input signal there is determined an error signal; exists a comparator for comparing the demodulated output signal and the one-shot pulse to produce pulse of representative the difference between the pulses; a demodulator for receiving data relative to the variation of speed and position of the motors on the basis of the detected parallel data to demodulate the data having a proper pulse width; a one-shot circuit for producing a pulse having time-width in proportion to an input voltage; a servo-motor driving circuit for driving the motor during the period of a high level of the pulse expanded by the pulse expansion circuit; a speed varying/driving circuit for determining a rotational speed of the motor (M1) on the basis of time width of the demodulated pulse signal and determining a stopage, forward rotation or reverse rotation of the motor in accordance with information from the received signal; and, an additional function driving circuit for operating an additional circuit in response to data from the received signal.

DETAILED DESCRIPTION OF THE PREFERRED EMBODIMENT

Figure 1:
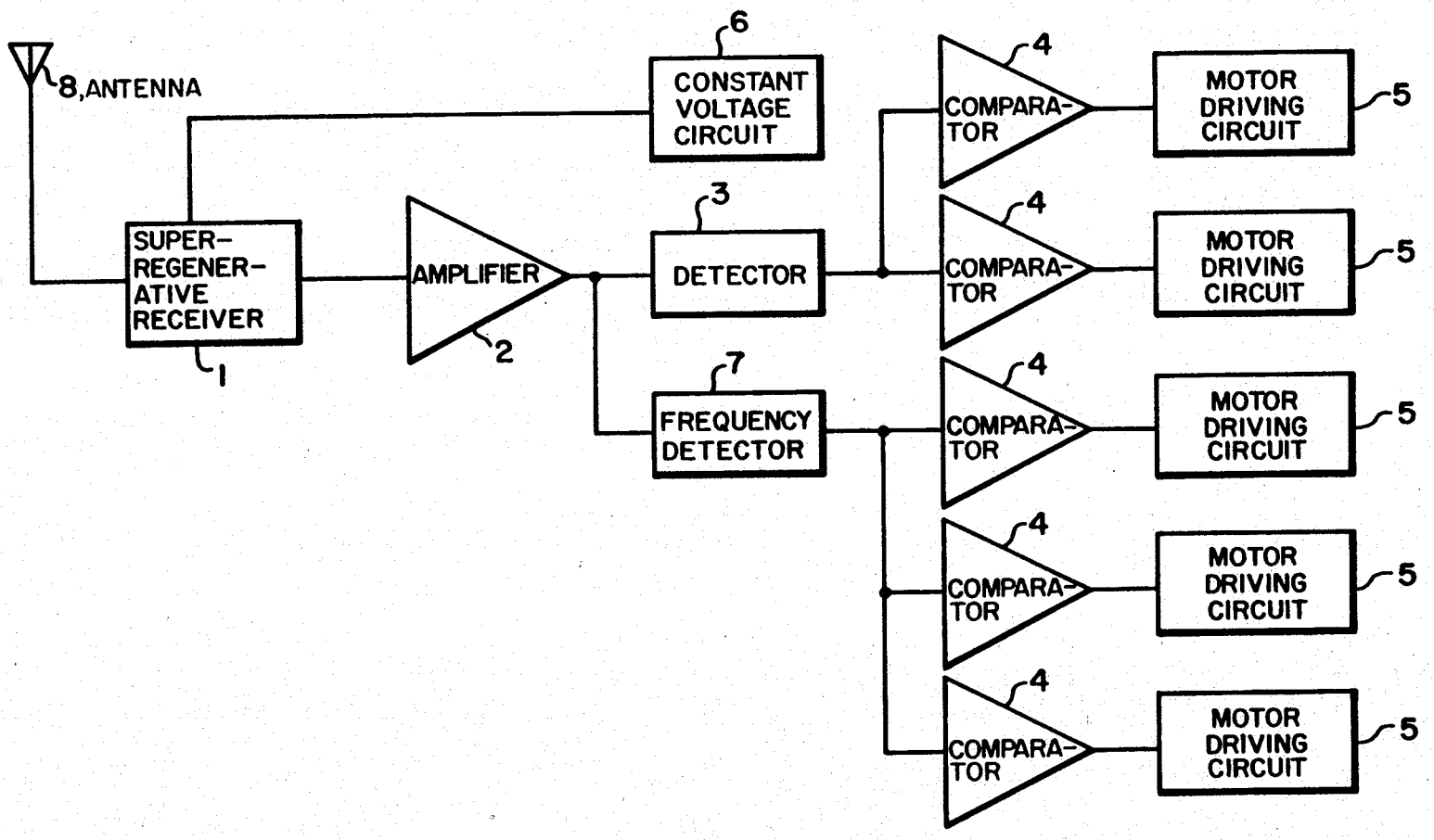
FIG. 1 (PRIOR ART)
FIG. 1 is block diagram of a conventional integrated circuit for driving a d.c motor which also includes a turbo function.
Figure 2:
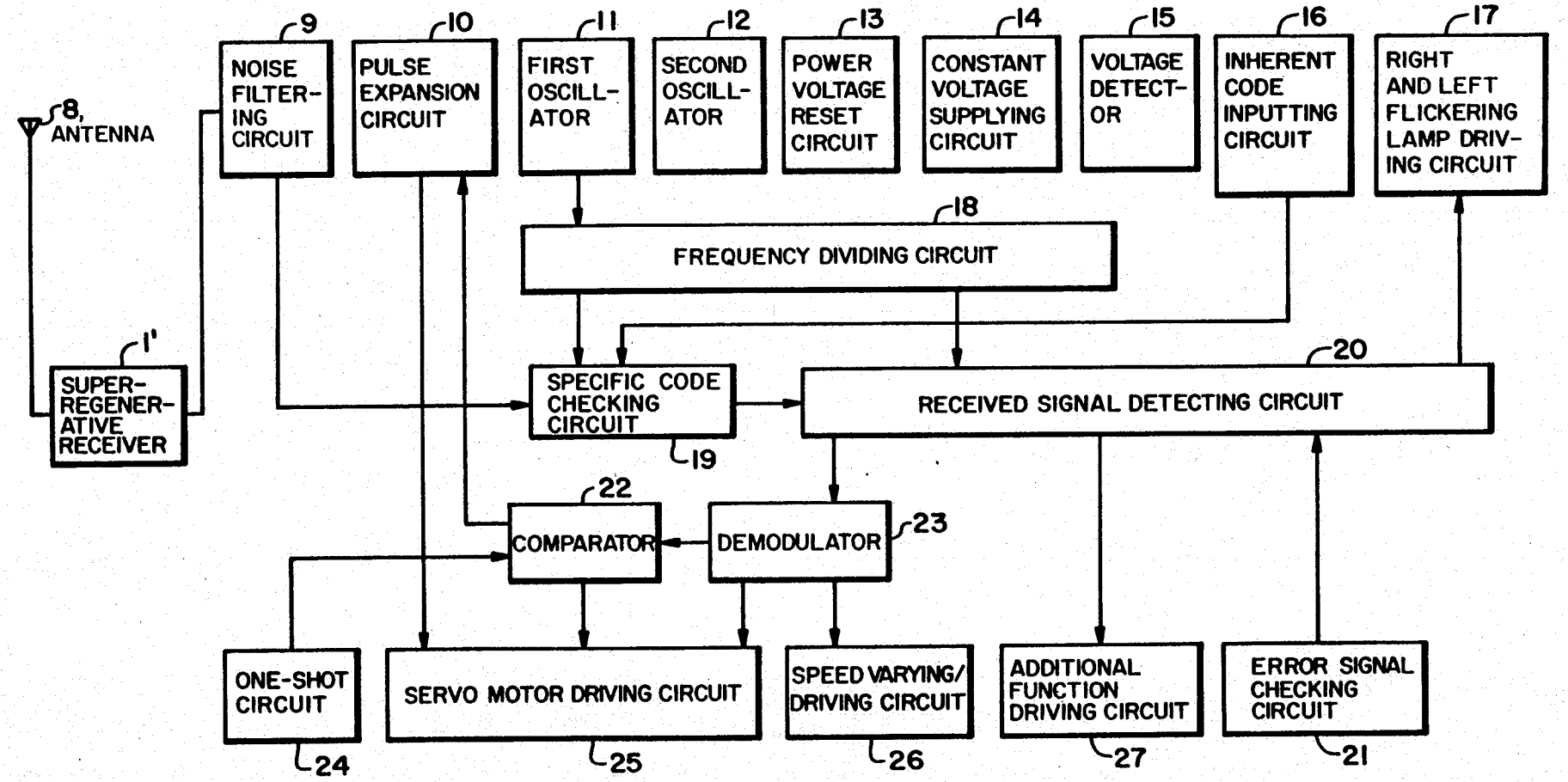
FIG. 2 is a block diagram of an integrated circuit having multi-function capability according to the present invention for driving a d.c motor.
Figure 3:
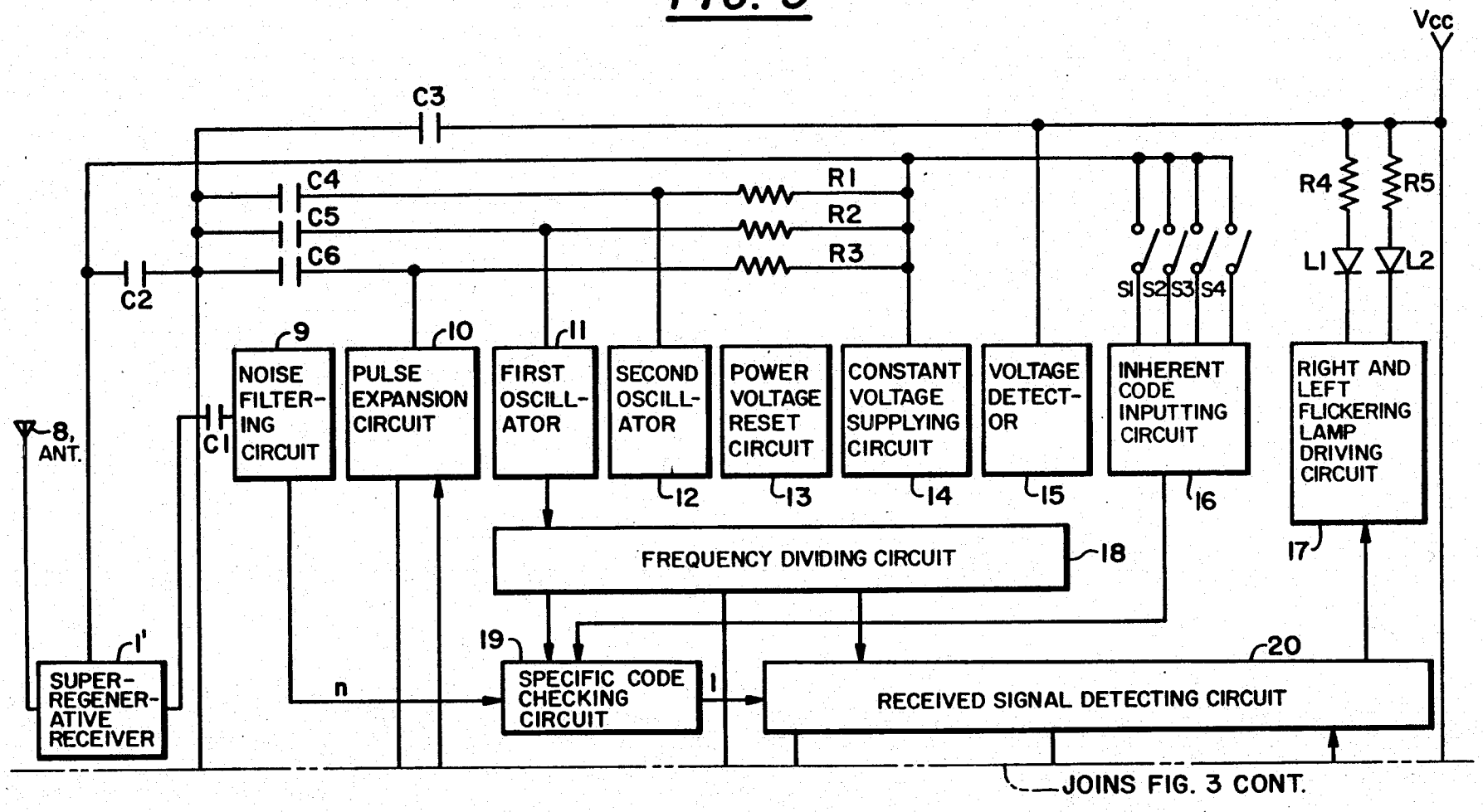
FIG. 3 is a detailed circuit diagram of the multi-function integrated circuit device according to the present invention; and, FIG. 4 is a waveform view illustrating input and output signals of main parts of the integrated circuit device according to the present invention.
Figure 3:
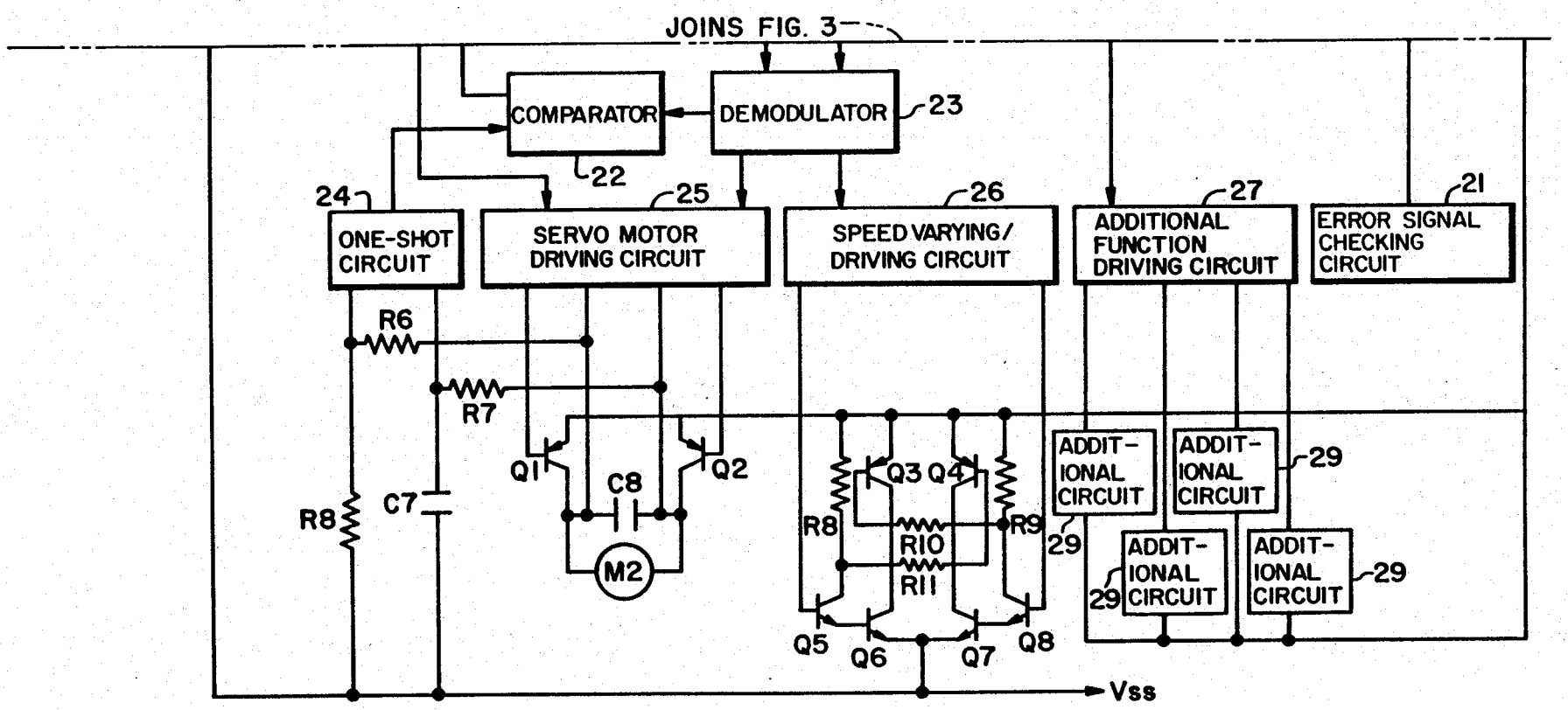
Figure 4:
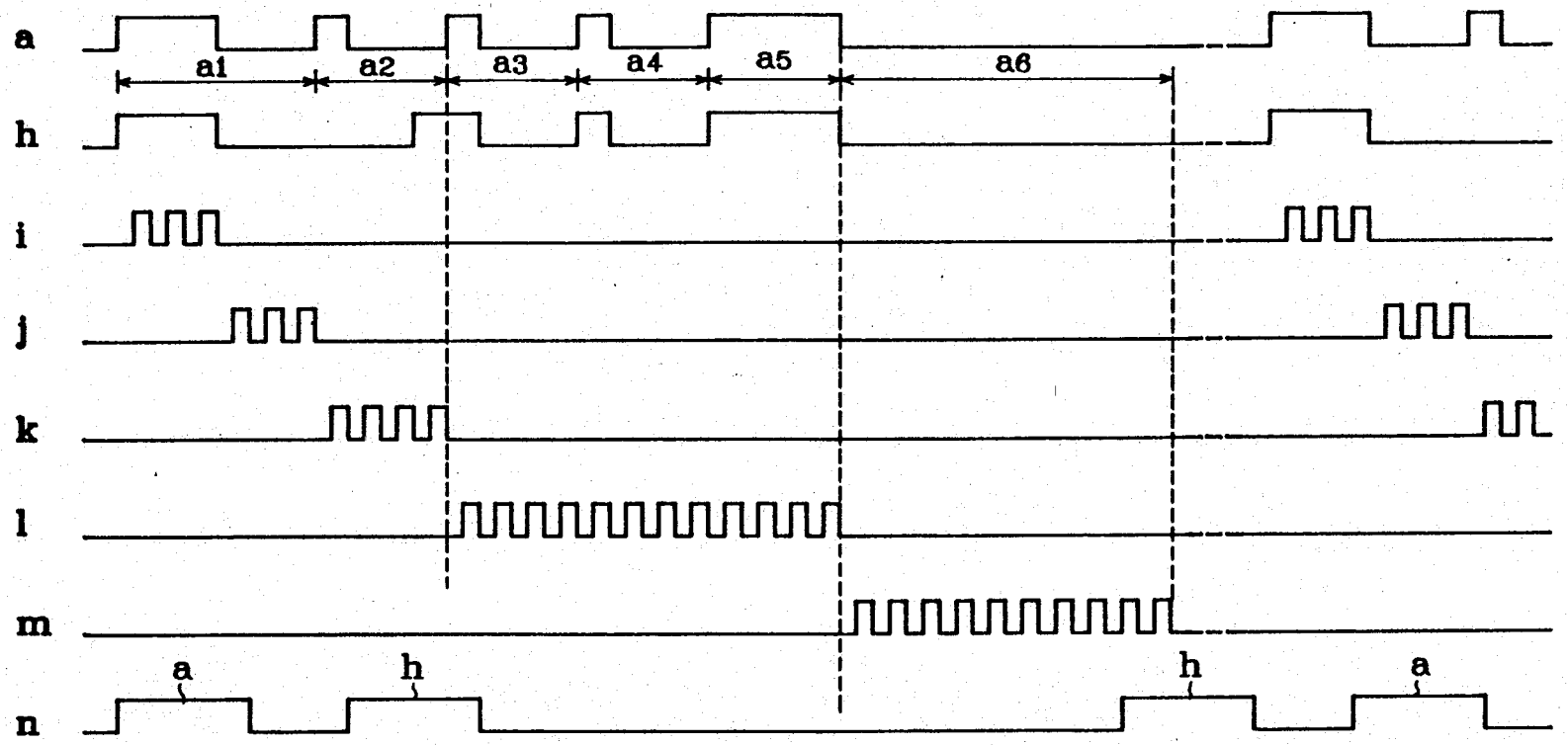

A preferred embodiment of the present invention will be described below with reference to the accompanying drawings, in which FIG. 2 is a block diagram of a multi-function integrated circuit device for driving a d.c motor according to the present invention, FIG. 3 is a detailed circuit diagram of the integrated circuit shown in FIG. 2, and FIG. 4 is a waveform view illustrating input and output signals of main parts of the integrated circuit device according to the present invention.

In the drawings, when the power supply voltage Vcc is applied to the integrated circuit device, the respective circuit is entirely initialized by a power voltage reset circuit 13. That is, in order to reset all of the circuit, an output signal of the reset circuit 13 is maintained at a low level for a predetermined time, the predetermined time being determined by an external time constant. Therefore, an input signal received through an antenna 8 is supplied to super-regenerative receiver means 1', which is amplified and detected. The detected signal is input to a noise filtering circuit 9 through a capacitor C1 so as to be noise filtered and converted into a signal synchronous with a reference frequency. Subsequently, the converted signal is thus provided as a proper waveform-shaped signal n, as shown in FIG. 4, to a specific code detecting circuit 19. The specific code is formed of a predetermined number of bits. Therefore, even if a large number of people use the same frequency simultaneously, it is possible to use the frequency without any interference.

Accordingly, in the case where the input signal, having a 4-bit specific signal, coincides with a high/low level state signal ("$a_1$" in FIG. 4) and the specific code signal ("$a_2$" in FIG. 4) of the received signal coincides with an inherent code previously stored in the receiver, an information-detected signal (signal 1 in FIG. 4) is generated so that the serial data of the input signal waveform-shaped by the received signal detect circuit 20 are converted into parallel data. Conversely, if a certain signal, for example, signal h in FIG. 4, does not coincide with a high/low level state "$a_1$" or the inherent code "$a_2$", then signal h is a non-conforming signal (signal h in FIG. 4), the received signal detecting signal is not output from received signal detector 20, thereby preventing the input of an additional function signal ($a_3$, $a_4$, $a_5$) shown in FIG. 4. In this case, the error signal detecting circuit 21 checks an error information signal $a_6$ shown in FIG. 4, which is positioned at a middle or end portion of the shaped signal. As a result, if the signal is an error signal, the parallel data is not stored into the memory of received signal detecting circuit 20, thereby allowing erroneous operation of the device to be minimized. Alternatively, if the signal is not an error signal, the parallel data is stored as a speed variable data signal ("$a_3$" in FIG. 4), a position variable data signal ("$a_4$" in FIG. 4) and an additional data signal ("$a_5$" in FIG. 4) into the memory of the received signal detecting circuit 20. The received signal thus stored in the memory means is maintained for a predetermined time.

Then, if a new signal is not input into the device for a long time, the device will be initialized. Meanwhile, the speed variable data signal "$a_3$" and the position variable data signal "$a_5$", each being formed by 4 bits, are supplied to a demodulator 23, which are demodulated to one of fifteen kinds of pulse width to control the motor M1 in fifteen steps. That is, the speed variable data signal "$a_3$" is demodulated properly into a pulse width having a proper magnitude relative to seven steps of forward rotation, seven steps of reverse rotation and one step of stopage, while the position variable data signal "$a_4$" is are demodulated properly into a pulse width having a proper magnitude relative to seven steps of left-rotation, seven steps of right-rotation and one step of forward motion. The speed variable data and the position variable data thus demodulated are supplied to the comparator 22 to obtain the difference in pulse width, which is then input to the pulse expansion circuit 10. Accordingly, the differential pulse is expanded up to the magnitude capable of driving the motor M2 by the pulse expansion circuit 10, and the expanded signal is supplied to the servo-motor driving circuit 25. In this case, if the difference in pulse width produced by the comparator 22 is very small in magnitude, the motor M2 is stopped and begins a new displacement path. Therefore, the motor M2 is turned to the right or left depending on the displacement information. Moreover, additional information signal "$a_5$" is input directly to the additional function driving circuit 27 and thus the additional circuit 29 connected to the additional function driving circuit 27 is operated, thereby allowing the additional function to be carried out. Here, the additional information f is formed with 4 bits so as to drive four additional functions.

Meanwhile, when motor M1 is rotated in the right or left direction, lamp L1 or L2 which is connected respectively to the right and left lamp driving circuit 17 is flickered by the displacement information signal "$a_4$" to indicate the right or left rotation.

Accordingly, the present invention provides the multi-funtional d.c motor driving integrated circuit device which utilizes a specific code of 4 bits and has four additional functions, right and left lamp driving circuit and two motor driving circuits, thereby allowing the forward and backward rotational speed of the motor to be changed in seven steps, respectively and the right and left positional variable operations of the motor to be executed in seven steps, respectively.

Accordingly, the motor is operated using 4-bit specific code by 16 users without interference of the same frequency band, and the receiver can be operated by using a single power supply voltage because the power voltage in the receiving circuit is used as a reference power voltage. In FIG. 4, signal "a" is an output waveform from the transmitter of an eighth user, and signal "h" is an output waveform from the transmitter of a first user.

Accordingly, the multi-functional d.c motor driving integrated circuit device of the present invention receives only the signal corresponding to the specific code previously stored in the receiver to allow the same frequency to be utilized by a large number of people simultaneously, thereby the coefficient of using the frequency is extremely improved. Also, the motor is operated linearly so that the variable speed and position can be changed in multi-stage and the driving circuit capable of directly executing the additional function is operably integrated so as to minimize the external respective elements thereby minimizing the size of the device. Further, since the device is provided with a noise filtering circuit and an error information detecting circuit, erroneous operations of the device generated at the drive of the d.c motor can also be minimized.

What is claimed is:

1. An integrated circuit device of multi-function for driving a d.c motor, the device comprising:

a noise filtering circuit for converting an input signal, having inherent code received and amplified by a super-regenerative receiver, into a desired magnitude of the input signal and removing noise by using a hysteresis and delay circuit therein;

a pulse expansion circuit for expanding a gap of time-width between a demodulated output signal and a one-shot pulse to time-width enough to drive the d.c. motor;

a first oscillator for exchanging frequency automatically to produce a reference frequency while modifying the inherent code in the receiver;

a second oscillator for producing a frequency determining ON/OFF timing of right and left flickering lamps of a vehicle toy;

a poser voltage reset circuit for preventing an erroneous operation generated in a moment at the time of turning ON/OFF of the power voltage;

a constant voltage supplying circuit for stabilizing operation of each circuit from ripple or noise during the start of the d.c. motor;

a voltage detector for stopping the operation of the output stage of the device, or for keeping operation of the integrated circuit device and maintaining the reference voltage stably when the power voltage is dropped below a predetermined level due to the start of the motor;

an inherent code inputting circuit for inputting a specific code selected by external switches;

right and left flickering lamp driving circuit for turning ON/OFF of the right or left flickering lamp at the time the vehicle toy is turned to right or left direction, the period of the turning ON/OFF is determined by a periodic time of the second oscillator;

a frequency dividing circuit for dividing the frequency from the first oscillator;

a specific code checking circuit for checking and comparing a specific code set in the receiver with the specific code of the input signal received;

a received signal detecting circuit for converting serially input data into paralleled data when a ready signal and the inherent code are coincided and determined as a proper signal;

an error signal checking circuit for not outputting any signal when the input signal determines an error signal exists;

a comparator for comparing the pulse of a demodulated output signal with the one-shot pulse to produce a pulse signal representative of the difference between the compared pulses;

a demodulator for receiving data relative to the variation of speed of the motor on the basis of the detected parallel data to demodulate the data having a pulse width of a proper magnitude;

a one-shot circuit for producing a pulse having a difference of time-width in proportion to an input voltage;

a servo-motor driving circuit for driving the motor during the period of a high level of the pulse by the pulse expansion circuit;

a speed varying/driving circuit for determining the rotational speed of the motor on the basis of time width of the demodulated pulse signal and determining a stop, forward rotation or reverse rotation of the motor in accordance with information of the received signal; and, an additional function driving circuit for operating an additional circuit in dependence on the information of the received signal.

2. The integrated circuit device of claim 1, wherein the frequency generated by said first oscillator is unverified at change of said inherent code, said frequency and said inherent code being unrelated to each other.

3. The integrated circuit device of claim 1, wherein said received signal detecting circuit compares repeatedly the preceding ready signal and the inherent code so as to decrease the error signal.

4. The integrated circuit device of claim 1, further comprising memory means for storing a signal until the preceding information is transmitted or the accurate signal is input after the error signal is input into said received signal detecting circuit.

5. The integrated circuit device of claim 1, wherein said error signal checking circuit detects an inverted signal and a specified signal so as to determine whether or not the received input signal is an error signal.

* * * * *